US010423117B2

(12) United States Patent
Takeuchi et al.

(10) Patent No.: US 10,423,117 B2
(45) Date of Patent: Sep. 24, 2019

(54) CLEANING APPARATUS AND PROCESS CARTRIDGE

(71) Applicant: CANON KABUSHIKI KAISHA, Tokyo (JP)

(72) Inventors: Toshiaki Takeuchi, Susono (JP); Ryoji Kusudo, Yokohama (JP); Hiroki Shimizu, Suntou-gun (JP); Kazuki Matsumoto, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 15/793,097

(22) Filed: Oct. 25, 2017

(65) Prior Publication Data

US 2018/0120754 A1 May 3, 2018

(30) Foreign Application Priority Data

Oct. 31, 2016 (JP) ..... 2016-213548
Aug. 30, 2017 (JP) ..... 2017-165699

(51) Int. Cl.
*G03G 21/00* (2006.01)
*G03G 15/08* (2006.01)

(52) U.S. Cl.
CPC ..... *G03G 21/0029* (2013.01); *G03G 15/0865* (2013.01); *G03G 21/0011* (2013.01); *G03G 2221/0021* (2013.01); *G03G 2221/1618* (2013.01)

(58) Field of Classification Search
CPC ..... G03G 21/0005; G03G 21/0011; G03G 21/0029; G03G 2221/0005; G03G 2221/0015; G03G 2221/0021; G03G 2221/0026; G03G 2221/0047; G03G 2221/0089
See application file for complete search history.

(56) References Cited

U.S. PATENT DOCUMENTS 6,137,973 A * 10/2000 Nishiuwatoko ..... G03G 21/181 399/111
9,304,444 B2 4/2016 Shimizu et al.
9,625,852 B2 4/2017 Shimizu et al.
9,684,276 B2 6/2017 Sasaki et al.
2002/0127036 A1* 9/2002 Sato ..... G03G 21/0029 399/350
2012/0082495 A1* 4/2012 Ichikawa ..... B08B 1/00 399/351
2014/0086618 A1* 3/2014 Shimizu ..... G03G 21/0029 399/102
2016/0252849 A1 9/2016 Hayashida et al.

FOREIGN PATENT DOCUMENTS

JP H05-142887 A 6/1993
JP 2008-139750 A 6/2008

* cited by examiner

*Primary Examiner* — Thomas S Giampaolo, II
(74) *Attorney, Agent, or Firm* — Venable LLP

(57) ABSTRACT

A support member that supports an elastic member constituted of an elastic body contacting the surface of an image bearing member has a first surface that extends in a rotation axis direction of the image bearing member, and a second surface that includes a normal vector, which intersects with a normal vector of the first surface, and extends in the rotation axis direction. In the rotation axis direction, the first surface is fixed to two fixed portions of the frame, and a first vibration absorbing member is disposed between the two fixed portions so as to contact the frame and the first surface.

9 Claims, 9 Drawing Sheets

CLEANING APPARATUS AND PROCESS CARTRIDGE

BACKGROUND OF THE INVENTION

Field of the Invention

The present invention relates to an image forming apparatus using an electrophotographic system.

Description of the Related Art

In an image forming apparatus, such as a printer using an electrophotographic image forming system (electrophotographic process), a cleaning unit is disposed to remove such deposited matter as toner from the surface of a movable body, such as a photosensitive member (photosensitive drum) and an intermediate transfer member, which are imaging bearing members to bear a developer image. For such a cleaning unit, a system to contact a cleaning member, such as a cleaning blade, to the movable body, is frequently used. The cleaning blade is normally a rubber blade, and a stable cleaning performance thereof is maintained by a very small amount of toner slipping through the gap between the movable body and the blade as a lubricant.

However as the quality of the material of the rubber blade improves, the cleaning performance improves, but the lubricating effect decreases, and in some cases self-induced vibration may be generated by the sliding friction between the photosensitive drum and the cleaning blade. In particular, in the case of the process cartridge type apparatus configuration, the self-induced vibration of the cleaning blade may become a vibration source, and propagate to the unit housing constituting the cartridge, resulting in the generation of an unpleasant noise.

As means to reduce the noise, a method of cancelling the sound by interfering with a sound in the opposite phase, using a speaker or the like, has been proposed (see Japanese Patent Application Publication No. H05-142887). A method, in which a cleaning blade includes a vibration detecting unit and vibration applying unit, and vibration is reduced by detecting the vibration of the cleaning blade using the vibration detecting unit and applying vibration in the opposite phase using the vibration applying unit, has also been proposed (see Japanese Patent Application Publication No. 2008-139750).

SUMMARY OF THE INVENTION

In the prior art, the vibration detecting unit, the vibration applying unit, the speaker and other additional composing elements are required, whereby control becomes complicated, and the cost of the process cartridge or the image forming apparatus increases.

It is an object of the present invention to provide a technique that can reduce noise using a simple configuration.

To achieve the above object, the cleaning apparatus of the present invention is a cleaning apparatus that is detachable from an apparatus main body of an image forming apparatus, comprising:

an image bearing member;

a blade member which includes an elastic member constituted of an elastic body contacting the surface of the image bearing member, and a support member supporting the elastic member; and a frame which rotatably supports the image bearing member and to which the support member is fixed, wherein the support member has a first surface that extends in a rotation axis direction of the image bearing member, and a second surface that includes a normal vector which intersects with a normal vector of the first surface and extends in the rotation axis direction, and in the rotation axis direction, the first surface is fixed to two fixed portions of the frame, and a first vibration absorbing member is disposed between the two fixed portions so as to contact the frame and the first surface.

To achieve the above object, the cleaning apparatus of the present invention is a cleaning apparatus that is detachable from an apparatus main body of an image forming apparatus, comprising:

an image bearing member;

a blade member which includes an elastic member constituted of an elastic body contacting the surface of the image bearing member, and a support member supporting the elastic member; and a frame which rotatably supports the image bearing member and to which the support member is fixed, wherein the support member has a first surface that extends in a rotation axis direction of the image bearing member, and a second surface that includes a normal vector which intersects with a normal vector of the first surface and extends in the rotation axis direction, and in the rotation axis direction, the first surface is fixed by two fixing members so as to contact two fixed portions of the frame, and a vibration absorbing member, of which length in the rotation axis direction is not more than ¼ the length of the second surface in the rotation axis direction, and of which loss factor tan δ, measured when vibration at a 100 Hz frequency is applied at a measurement temperature 23° C.±2° C. is at least 0.6 and not more than 2.0, is disposed between the frame and the second surface, so that the vibration absorbing member is located in a middle point between the two fixed members in the rotation axis direction.

To achieve the above object, the process cartridge of the present invention is a process cartridge that is detachable from an apparatus main body of an image forming apparatus, comprising the cleaning apparatus.

According to the present invention, noise can be reduced using a simple configuration.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

Electrophotographic Image Forming Apparatus

Figure 2:
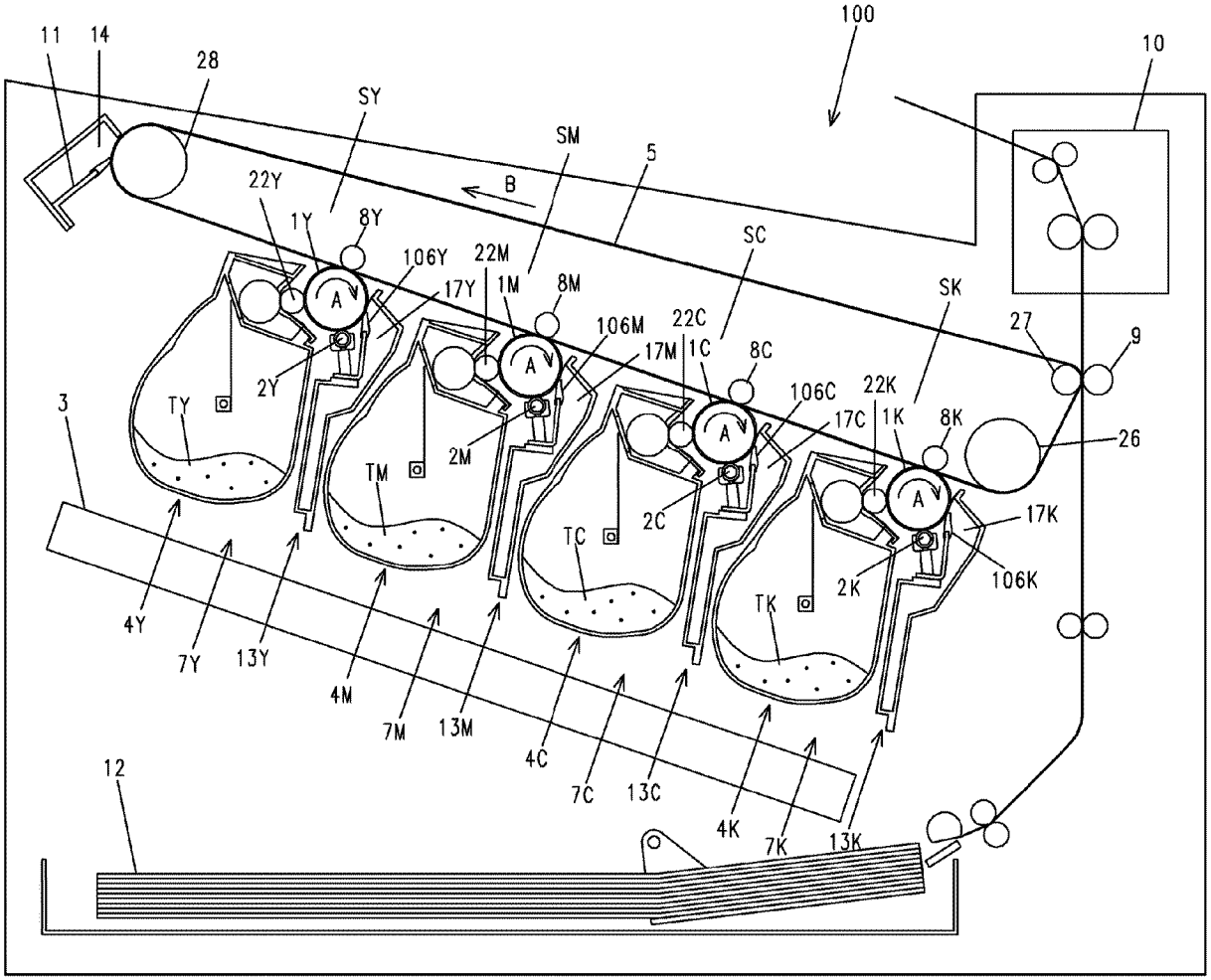
FIG. 2 is a schematic cross-sectional view of the image forming apparatus and the process cartridge according to Example 1 of this invention.
Figure 3:
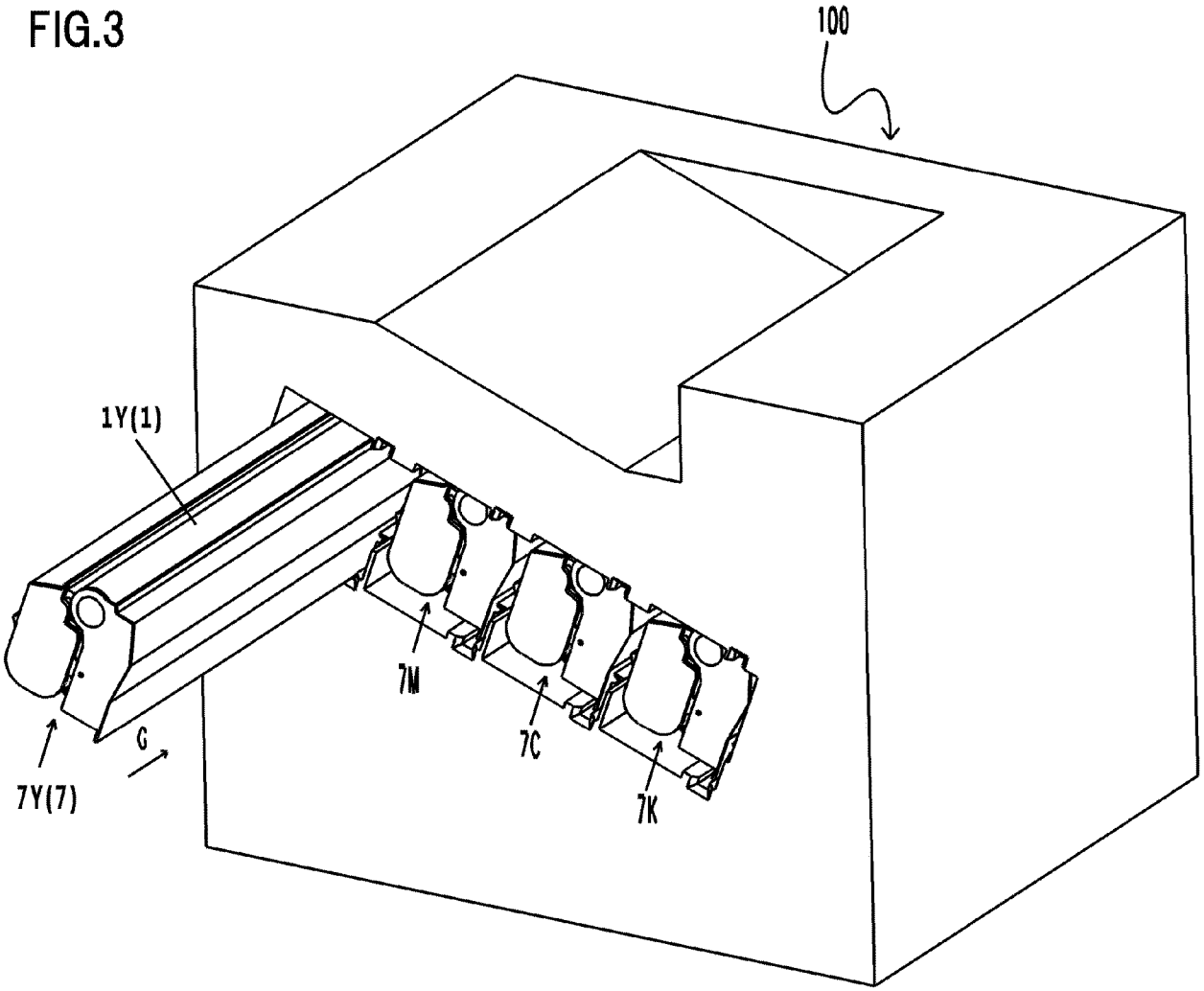
FIG. 3 is a perspective view of the image forming apparatus and the processing cartridge according to Example 1 of this invention.

A general configuration of an electrophotographic image forming apparatus (imaging forming apparatus) according to an example of this invention will be described with reference to FIG. 2 and FIG. 3. FIG. 2 is a schematic cross-sectional view of an image forming apparatus 100 of this example. FIG. 3 is a perspective view depicting the state of inserting a process cartridge 7 into the image forming apparatus 100. Here the electrophotographic image forming apparatus (hereafter also called "image forming apparatus") forms an image on a recording material (recording medium) using the electrophotographic image forming system. Example of the image forming apparatus include: a copier, a printer (e.g. laser beam printer and LED printer), a facsimile, a word processor and an integrated machine thereof (a multi-function printer). The image forming apparatus according to this example is configured such that the cleaning apparatus and the process cartridge are attachable to/detachable from the apparatus main body. The apparatus main body refers to a component of the image forming apparatus, excluding the cleaning apparatus and the process cartridge.

The image forming apparatus 100 has a plurality of image forming portions, which are first, second, third and fourth image forming portions SY, SM, SC and SK, to form images having yellow (Y), magenta (M), cyan (C) and black (K) colors respectively. In this example, the configuration and operation of the first to fourth image forming portions are essentially the same, except that the color of the image to be formed is different. Therefore in the following, the image forming portion is described omitting Y, M, C and K unless a distinction is necessary.

The image forming apparatus 100 has four photosensitive drums 1 (1Y, 1M, 1C, 1K) as the image bearing members. The photosensitive drum 1 rotates in the arrow A direction figures. Around the photosensitive drum 1, a charging roller 2 (2Y, 2M, 2C, 2K) is disposed. The charging roller 2 here is a charging unit to evenly charge the surface of the photosensitive drum 1. Around the photosensitive drum 1, a developing apparatus (hereafter called "developing unit") 4 (4Y, 4M, 4C, 4K) and a cleaning blade 106 (106Y, 106M, 106C, 106K), which is a cleaning unit (blade member), are disposed. Further, an intermediate transfer belt 5, which is an intermediate transfer member, to transfer a toner image on the photosensitive drum 1 to a recording material 12, is disposed so as to face the four photosensitive drums 1. In this example, the developing unit 4 uses a non-magnetic one-component developer, that is, toner T (TY, TM, TC, TK), as a developer. In this example, the developing unit 4 performs contact development by contacting a developing roller 22, which is a developer bearing member, with the photosensitive drum 1.

In this example, the photosensitive drum 1, the charging roller 2, the cleaning blade 106, and a removed developer storing portion (hereafter called "waste toner storing portion") 17 (17Y, 17M, 17C, 17K) constitute a photosensitive member unit 13 (13Y, 13M, 13C, 13K). The untransferred toner (waste toner) remaining on the photosensitive drum 1 is removed from the photosensitive drum 1 by the cleaning blade 106, and is stored in the waste toner storing unit 17.

Further, in this example, the developing unit 4 and the photosensitive member unit 13 are integrated to a process cartridge 7 (7Y, 7M, 7C, 7K) for each color, so as to be detachable from the main body of the image forming apparatus 100. The process cartridge 7 is detachable from the image forming apparatus 100 via an inserting unit, such as an inserting guide and a positioning member (not illustrated) disposed in the image forming apparatus 100. In this example, the process cartridge 7 can be inserted into the main body of the image forming apparatus 100 in the arrow G direction in FIG. 3, which is the axis line direction of the photosensitive drum 1. In this example, the shape of the four process cartridges 7 for each color are identical. In the process cartridge 7 for each color, toner T (TY, TM, TC, TK) of each yellow (TY), magenta (TM), cyan (TC) and black (TK) color is stored respectively.

The intermediate transfer belt 5 contacts all the photosensitive drums 1, and rotates in the arrow B direction in FIG. 2. The intermediate transfer belt 5 is wound around a plurality of supporting members (driver roller 26, secondary transfer counter roller 27, and driven roller 28). Four primary transfer rollers 8 (8Y, 8M, 8C, 8K), which are primary transfer units, are disposed side by side on the inner surface side of the intermediate transfer belt 5, so as to face each photosensitive drum 1. Further, a secondary transfer roller 9, which is a secondary transfer unit, is disposed on the outer surface side of the intermediate transfer belt 5 at a position facing the secondary transfer counter roller 27. A scanner unit (exposing apparatus) 3 is disposed in the main body of the image forming apparatus 100 for the process cartridge 7 in a position facing the intermediate transfer belt 5. The scanner unit 3 is an exposing unit, which irradiates laser based on the image information, forms an electrostatic image (electrostatic latent image) on the photosensitive drum 1.

Image Forming Process

When an image is formed, the surface of the photosensitive drum 1 is uniformly charged first by the charging roller 2. Then the surface of the charged photosensitive drum 1 is scanned and exposed by a laser light, which is emitted from the scanner unit 3 in accordance with the image information, and an electrostatic latent image corresponding to the image information is formed on the photosensitive drum 1. Then the electrostatic latent image formed on the photosensitive drum 1 is developed as a toner image by the developing unit 4. The toner image formed on the photosensitive drum 1 is transferred onto the intermediate transfer belt 5 (primary transfer) by the function of the primary transfer roller 8.

For example, when a full color image is formed, the above mentioned process is sequentially performed by the first to fourth image forming portions SY, SM, SC and SK, and a toner image of each color is sequentially superimposed on the intermediate transfer belt 5 as the primary transfer. Then synchronizing with the movement of the intermediate transfer belt 5, the recording material 12 is transported to the secondary transfer unit. Next by a function of the secondary transfer roller 9, which is in contact with the intermediate transfer belt 5 via the recording material 12, the four-color toner images on the intermediate transfer belt 5 are transferred onto the recording material 12 in batch as the secondary transfer. The recording material 12, on which the toner image was transferred, is transported to the fixing apparatus 10, which is a fixing unit. The toner image is fixed to the recording material 12 by the fixing apparatus 10 applying heat and pressure to the recording material 12, and the recording material 12 is discharged to the outside, and the image forming operation ends.

The primary untransferred toner, which remained on the photosensitive drum 1 after the primary transfer step, is removed by the cleaning blade 106. The secondary untransferred toner, which remained on the intermediate transfer belt 5 after the secondary transfer step, is removed by an intermediate cleaning apparatus 11. The removed untransferred toner is discharged to a waste toner box 14 of the image forming apparatus 100. The image forming apparatus 100 can also form a single color or a multi-color image using only a desired single or a plurality of (not all) the image forming portions.

Process Cartridge

Figure 1:
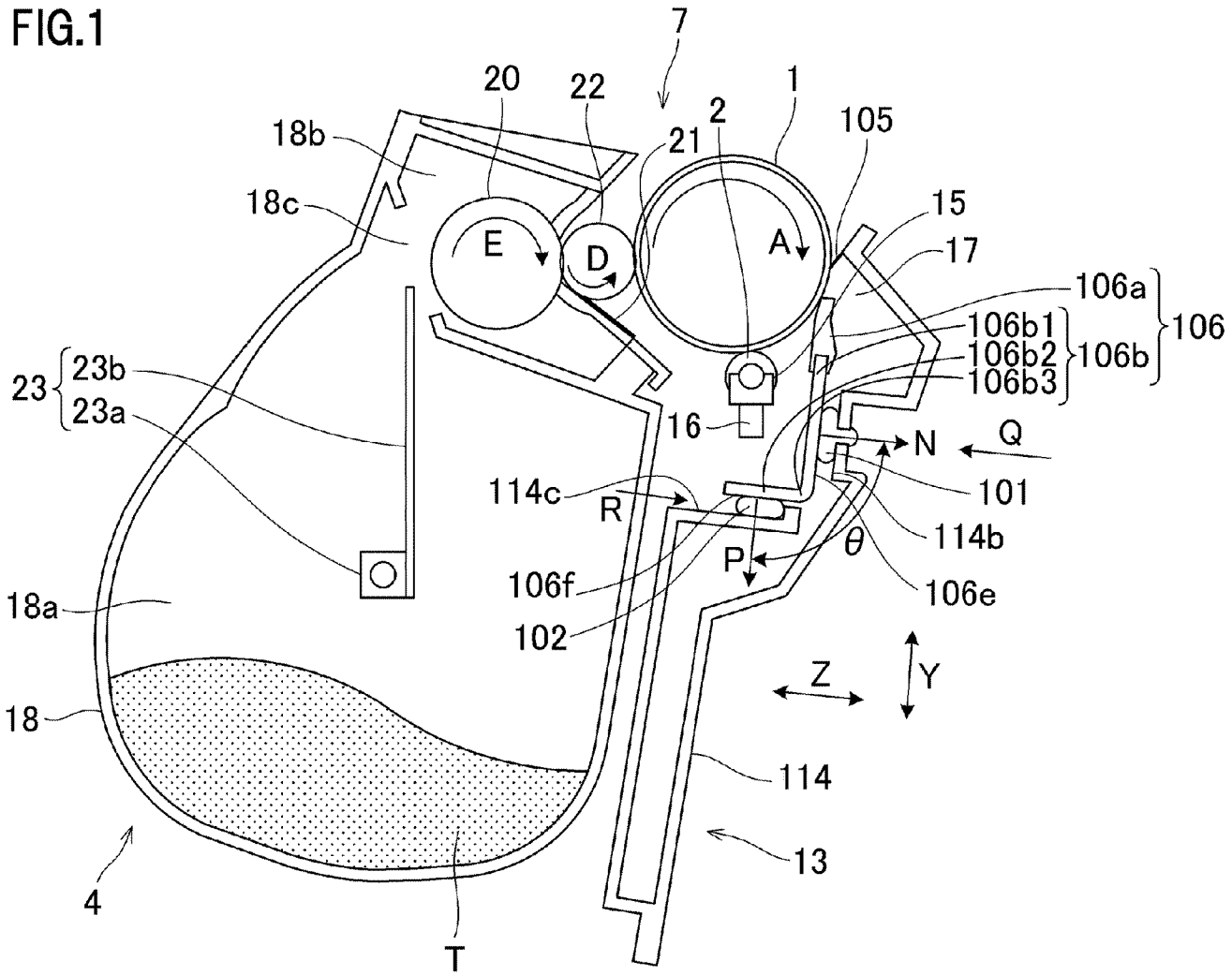
FIG. 1 is a schematic cross-sectional view of a process cartridge according to Example 1 of this invention.

A general configuration of the process cartridge 7, which is attached to the image forming apparatus 100 of this example, will be described with reference to FIG. 1. FIG. 1 is a schematic cross-sectional view of the process cartridge 7. The developing unit 4 has a developing frame 18 which supports various composing elements in the developing unit 4. The developing roller 22, which is a developer bearing member, is disposed in the developing unit 4, so as to contact the photosensitive drum 1 and rotate in the arrow D direction (counterclockwise) in FIG. 1. Both ends of the developing roller 22, in the longitudinal direction (rotation axis line direction) are rotatably supported by the developing frame 18 via bearings.

The developing unit 4 includes a developer storing chamber (hereafter called "toner storing chamber") 18*a*, a developing chamber 18*b* in which the developing roller 22 is disposed, and an opening 18*c* which connects the toner storing chamber 18*a* and the developing chamber 18*b*. In the developing chamber 18*b*, a toner supply roller 20 which is a developer supply member which contacts the developing roller 22 and rotates in the arrow E direction, and a developing blade 21 which is a developer control member, to control the toner layer of the developing roller 22, are disposed. A stirring member 23, which stirs the stored toner T and transports the toner to the toner supply roller 20 via the opening 18*c*, is disposed in the toner storing chamber 18*a* of the developing frame 18. The stirring member 23 includes a rotation shaft 23*a* disposed in parallel with the rotation axis line direction of the developing roller 22, and a stirring sheet 23*b*, which is a flexible sheet member of which one end is installed in the rotation shaft 23*a*, stirs and transports the toner.

The photosensitive member unit 13 includes a cleaning frame 114, which is a frame to support various composing elements in the photosensitive member unit 13. The photosensitive drum 1 is installed in the cleaning frame 114 so as to be rotatable in the arrow A direction in FIG. 1 via a bearing member. Further, a charging roller bearing 15 is installed in the cleaning frame 114, and the charging roller 2 is rotatably installed on the charging roller bearing 15. The charging roller 2 is disposed such that the line passing through the rotation center thereof is along the line passing through the rotation center of the photosensitive drum 1, and is biased by a charging roller pressurizing spring 16, which is a biasing unit, toward the photosensitive drum 1 via the charging roller bearing 15.

The cleaning blade 106 is integrally formed by an elastic member 106*a*, constituted by such an elastic body as rubber to remove the untransferred toner or residual toner (waste toner) remaining on the surface of the photosensitive drum 1 after the primary transfer, and a support member 106*b*, constituted by a metal plate to support the elastic member 106*a*. The waste toner removed from the surface of the photosensitive drum 1 by the cleaning blade 106 drops into the space formed by the cleaning blade 106 and the cleaning frame 114 in the gravity direction, and is stored in the waste toner storing portion 17.

Method Fixing Cleaning Blade

Figure 4:
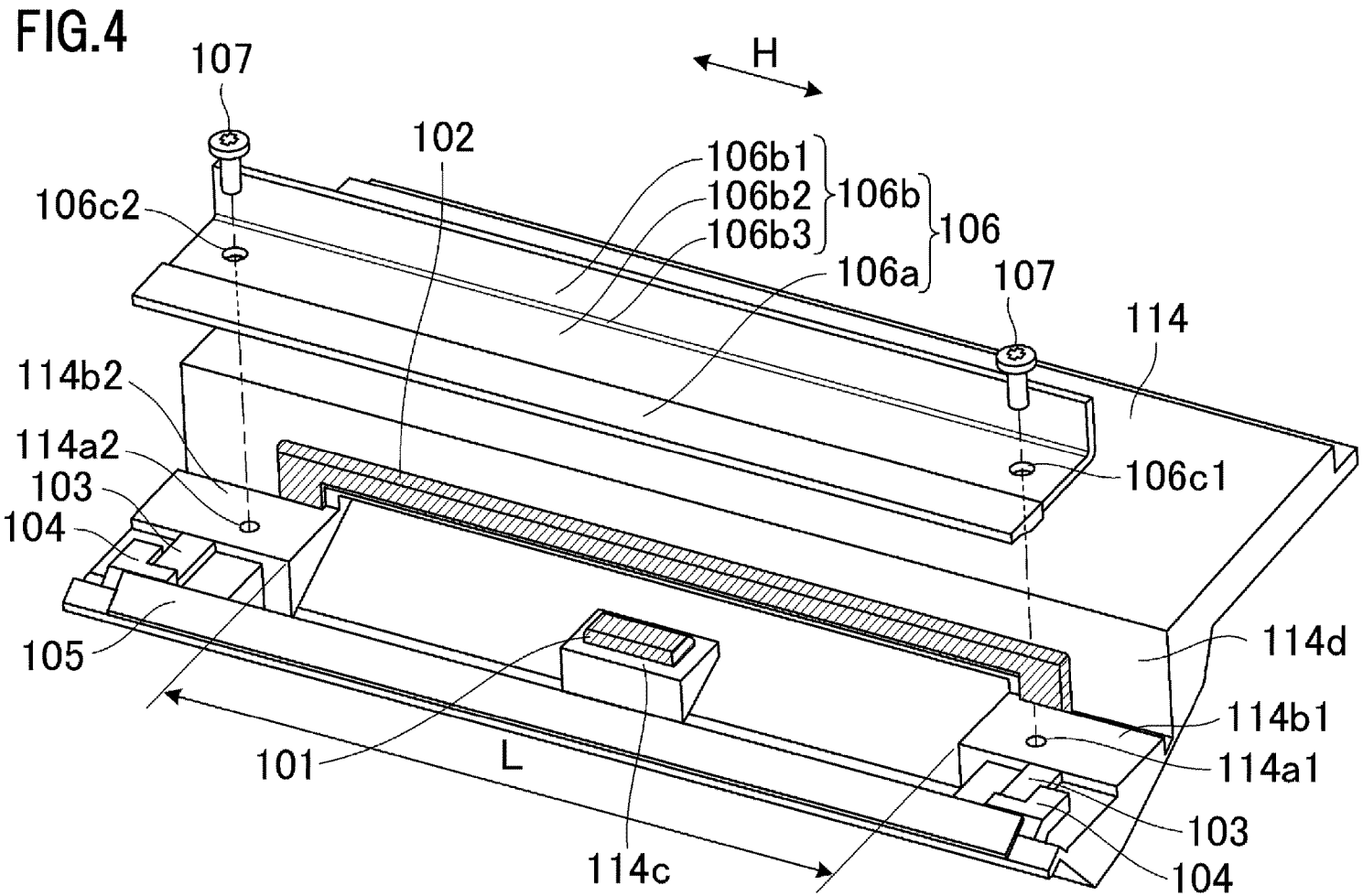
FIG. 4 is a schematic perspective view of the process cartridge according to Example 1 of this invention.

A method of fixing the cleaning blade 106 to the cleaning frame 114 will be described with reference to FIG. 1 and FIG. 4. FIG. 4 is a schematic perspective view to describe the method of fixing the cleaning blade 106. As illustrated in FIG. 1 and FIG. 4, the support member 106*b* of the cleaning blade 106 has a support portion 106*b*1 in which the elastic member 106*a* is installed, and a reinforcing portion 106*b*2 which is connected with the support portion 106*b*1 via a bend portion 106*b*3. In other words, the support member 106*b* has a shape of being bent at an approximately right angle along a bend line which extends in the longitudinal direction (axis line direction or rotation axis direction of the photosensitive drum 1), and includes the support portion 106*b*1 which is the first plate portion, and the reinforcing portion 106*b*2 which is the second plate portion. The support portion 106*b*1 supports the elastic member 106*a* on the opposite side of the side connected to the bend portion 106*b*3 (side on which the reinforcing portion 106*b*2 is disposed). The elastic member 106*a* is disposed from one end to the other end of the support member 106*b*1 in the longitudinal direction. The cleaning blade 106 extends from the side of the support portion 106*b*1 connected to the bend portion 106*b*3 to the side supporting the elastic member 106*a*, in the opposite direction of the rotation direction of the photosensitive drum 1. In other words, the cleaning blade 106 of this example is configured so that the elastic member 106*a* faces and contacts the photosensitive drum 1.

The support member 106*b*, constituted by an electrogalvanized zinc plated steel or the like has a bend portion and reinforcing portion so as to improve rigidity. A fixing hole 106*c*1 and a fixing hole 106*c*2 are formed on both ends of the support portion 106*b*1 respectively, at least in the axis line direction (hereafter called "longitudinal direction") of the photosensitive drum 1.

In the cleaning frame 114, an engaging portion 114*a*1 and an engaging portion 114*a*2 are disposed respectively at positions facing the fixing holes 106*c*1 and 106*c*2 of the cleaning blade 106. Screws 107 are fixed to the engaging portions 114*a*1 and 114*a*2 of the cleaning frame 114 respectively via the fixing holes 106*c*1 and 106*c*2, whereby the cleaning blade 106 is supported and secured by bearing surfaces 114*b*1 and 114*b*2 (fixed portions). Here the cleaning blade 106 is fixed to the cleaning frame 114 by screws on both ends of the cleaning blade 106, but the present invention is not limited to this, and adhesive, welding, insert molding or the like may be used.

Disposition of Vibration Absorbing Members

The disposition of the vibration absorbing members will be described with reference to FIG. 1. As illustrated in FIG. 1, it is assumed that in the support portion 106*b*1 of the support member 106*b*, a plane contacting the bearing surfaces 114*b*1 and 114*b*2 of the cleaning frame 114 is a first plane 106*e* (first surface). The first plane 106*e* is a plane extending in the longitudinal direction and a direction orthogonal to the longitudinal direction of the elastic member 106*a*, and the cleaning blade 106 is fixed to the frame 114 at both ends of the first plane 106*e* of the support portion 106*b*1 in the longitudinal direction. It is also assumed that a plane facing the cleaning frame 114 in the reinforcing portion 106*b*2 is a second plane 106*f* (second surface). The second plane 106*f* is a plane extending in the longitudinal direction and a direction intersecting with the first plane 106*e* in a direction orthogonal to the longitudinal direction (more specifically, a direction orthogonal to the first plane 106*e*). Here a normal vector N of the first plane 106*e* and a normal vector P of the second plane 106*f* are vectors of which directions are different from each other, and are orthogonal to the axis line direction of the photosensitive drum 1 (arrow H direction in FIG. 4) respectively. In this example, the normal vector N and the normal vector P are orthogonal to each other, but the present invention is not limited to this, and the normal vector N and the normal vector P may simply cross, as long as the effect of the present invention can be obtained. The first plane 106*e* and the second plane 106*f* are surfaces on the opposite sides of the surfaces of the support member 106*b* facing the photosensitive drum 1.

In the cleaning frame 114, on the other hand, a first support portion 114*c* is disposed at least in a region L (see FIG. 4) which faces the first plane 106*e* and is between the bearing surfaces 114*b*1 and 114*b*2 in the longitudinal direction. Further, in the cleaning frame 114, a second support portion 114*d* is disposed at least in a region L (see FIG. 4) which faces the second plane 106*f* and is between the bearing surfaces 114*b*1 and 114*b*2 in the longitudinal direction. Then a first vibration absorbing member 101 and a second vibration absorbing member 102 are disposed respectively between the first support portion 114*c* and the first plane 106*e*, and between the second support portion 114*d* and the second plane 106*f*. The first vibration absorbing member 101 is disposed between two fixed portions between the support member 106*b* of the cleaning blade 106 and the frame 114. The second vibration absorbing member 102 is disposed to extend from a position overlapping with one of the two fixing portions in the longitudinal direction to a position overlapping with the other fixing portion in the longitudinal direction. For the vibration absorbing member, thermoplastic resin elastomer or the like, which has viscoelasticity, is used, and a PS type elastomer, of which loss factor tan δ at 25° C. is about 0.2 to 0.8, is used, for example.

Now tan δ will be described. The tan δ is a physical property called a "loss factor (loss tangent)", and is determined by the tangent of the stress and the loss angle δ of strain, that is, the ratio of the storage shear modulus and the loss shear modulus, and indicates how much energy the material absorbs when the material deforms. The tan δ can be measured by a dynamic viscoelasticity measuring apparatus. δ is a phase shift (phase difference) between the sine wave of a vibration strain applied to the measurement object and the sine wave of a stress in a measurement result, and indicates the change amount of δ per unit time. In other words, the slope of the sine wave indicates the strain rate. The strain rate, that is, the slope of the sine wave, is the maximum when the strain is 0, and is the minimum (0) when the strain is the maximum. Since the elasticity depends on the strain, and the viscosity depends on the strain rate, the phase difference δ becomes closer to 0° as the ratio of the storage shear modulus, which is an elastic component, is higher, and the phase difference becomes closer to 90° as the ratio of the loss elastic modulus, which is a viscous component, is higher. Therefore tan δ indicates an energy amount that is absorbed when the material deforms, and a greater attenuation effect can be obtained as the value of the loss factor tan δ is greater.

Vibration of Cleaning Blade and Disposition of Vibration Absorbing Member

The vibration of the cleaning blade and the disposition of the vibration absorbing member will be described with reference to FIG. 1. As illustrated in FIG. 1, in some cases the elastic member 106*a* of the cleaning blade 106 may rub against the photosensitive drum 1, which is rotating in the arrow A direction, and a self-induced vibration may be generated. In this case, the vibration of the support member of the cleaning blade 106 at least has a component that is horizontal to the first plane 106*e* (arrow Y direction component), and a component that is orthogonal to the first plane 106*e* (arrow Z direction component).

Here the normal vector P of the second plane 106*f* of the cleaning blade 106 is disposed to have an angle θ from the normal vector N of the first plane 106*e*, and in this example the angle θ is 90°. Thereby the Y direction component of the vibration of the cleaning blade 106 can be attenuated by the second vibration absorbing member 102, and the Z direction component of the vibration of the cleaning blade 106 can be attenuated by the first vibration absorbing member 101 respectively, and as a result, the vibration of the cleaning blade 106 can be effectively reduced. In other words, by disposing a vibration absorbing member for two surfaces having different angles, not only the vibration in one direction but the vibration from various directions orthogonal to the drum axis line as well can be attenuated.

Figure 5A:
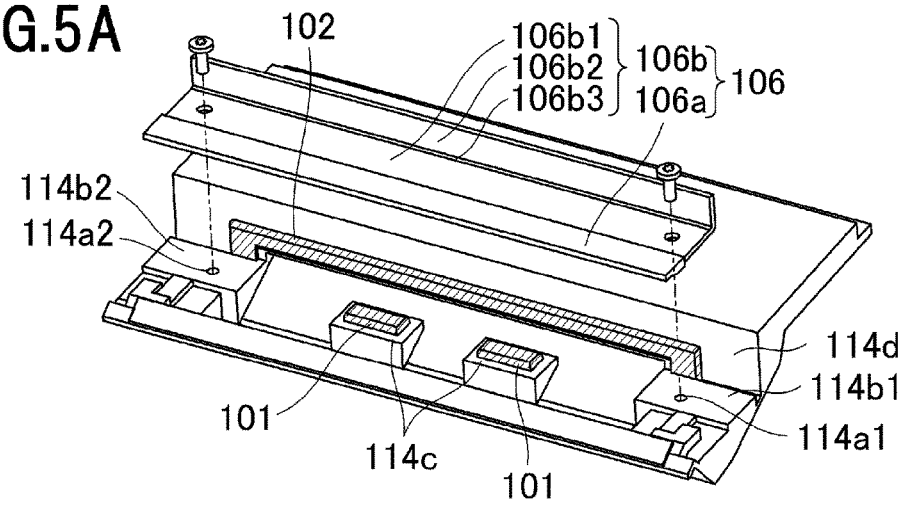
FIG. 5A to FIG. 5C are schematic perspective views of the process cartridge according to Example 1 of this invention.
Figure 5B:
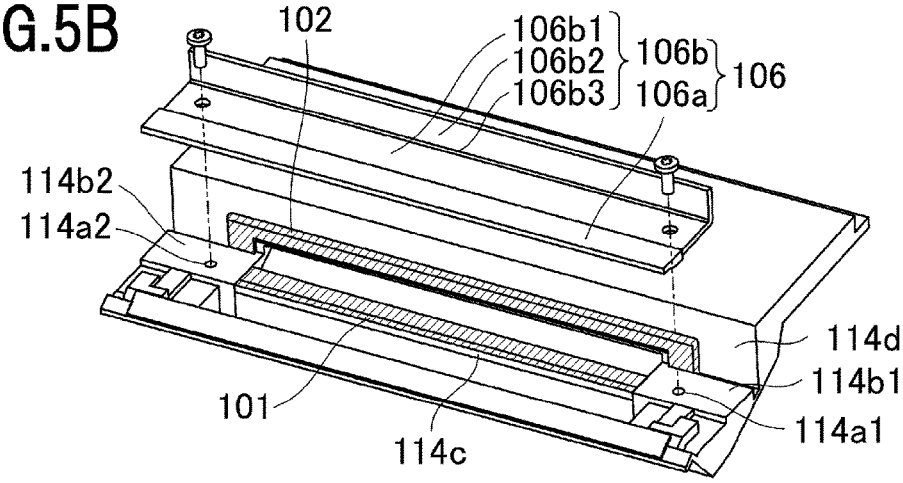
Figure 5C:
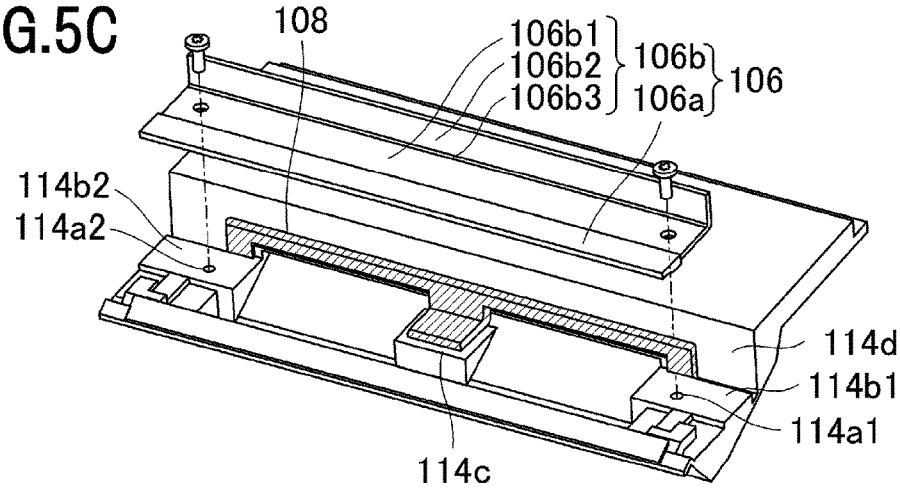

FIG. 5A to FIG. 5C are schematic perspective views depicting the method of fixing the cleaning blade 106 according to each modification of this example. As illustrated in FIG. 4, in this example, the first vibration absorbing member 101 is disposed only at the center portion in the longitudinal direction, and the second vibration absorbing member 102 is extended in the longitudinal direction, but as illustrated in FIG. 5A, a plurality of first vibration absorbing members 101 may be disposed in the longitudinal direction (modification 1). Further, as illustrated in FIG. 5B, not only the second vibration absorbing member 102 but the first vibration absorbing member 101 as well may be extended in the longitudinal direction, from one fixed portion to the other fixed portion (modification 2). In the case of this configuration, however, the waste toner storing portion 17 of the cleaning frame 114 is separated into two spaces by the first vibration absorbing member 101, hence it is preferable that a passage and the like, to connect these two spaces, is formed in the cleaning frame 114. In this example, the first vibration absorbing member 101 and the second vibration absorbing member 102 are separated, but may also be integrated, as a vibration absorbing member 108 illustrated in FIG. 5C (modification 3).

According to this embodiment, the support member 106*b* has an L-shaped cross-section, constituted by the support portion 106*b*1 in which the elastic member 106*a* is installed, and the reinforcing portion 106*b*2 which is connected with the support portion 106*b*1 via the bend portion 106*b*3. However, the support member is not limited to this, but may have any configuration if the support member has a first plane 106*e* and a second plane 106*f*, and the vibration absorbing member can be disposed in the first plane 106*e* and the second plane 106*f* of which angles are different from each other. A support member having a tubular shape or having a flat plate shape with a predetermined thickness may be used if constituted by a support portion in which the elastic member is installed, and a surface which is connected with the support portion via the bend portion.

Method of Installing Vibration Absorbing Member

A method of installing the vibration absorbing member will be described with reference to FIG. 1. The first vibration absorbing member 101 and the second vibration absorbing member 102 are molded and installed by injecting an elastomer material into the gap between the cleaning frame 114 (made of resin), and the support member 106*b* (made of metal). In other words, a thermoplastic elastomer material (synthetic rubber material) is melted at high temperature, and is injected into the gap between the cleaning frame 114 and the cleaning blade 106 in the arrow Q direction and in the arrow R direction in FIG. 1 respectively, then cooled. Thereby the first vibration absorbing member 101 and the second vibration absorbing member 102 are installed, as illustrated in FIG. 1. In the case of disposing the first vibration absorbing member 101 and the second vibration absorbing member 102 between the cleaning frame 114 and the cleaning blade 106, the cleaning blade 106 must be disposed while compressing the first vibration absorbing member 101 and the second vibration absorbing member 102. However, according to this example, the first vibration absorbing member 101 and the second vibration absorbing member 102 can be formed after installing the cleaning blade 106 in the cleaning frame 114. Therefore the cleaning blade 106 can be installed in the cleaning frame 114 at high positional accuracy.

The installation method is not limited to this, but the cleaning blade 106 may be installed in the cleaning frame 114 in which the vibration absorbing members are two-color molded. Alternatively, a vibration absorbing member may be adhered to either the cleaning frame 114 or the cleaning blade 106 first, then the cleaning blade 106 may be installed in the cleaning frame 114.

Seal Configuration of Waste Toner Storing Portion

The seal configuration of the waste toner storing portion 14*a* will be described with reference to FIG. 4. As illustrated in FIG. 4, a first seal member 103 and a second seal member 104 (edge seal members) are disposed respectively in the cleaning frame 114 on both ends of the cleaning blade 106. Further, a seat member 105 (scooping sheet) is disposed in the cleaning frame 114 on the upstream side of the cleaning blade 106 in the rotating direction of the photosensitive drum 1 (arrow A direction in FIG. 1), so as to extend in the longitudinal direction, and contact the photosensitive drum 1. The second vibration absorbing member 102 continuously seals the gap between the cleaning frame 114 and the cleaning blade 106 from one bearing surface 114*b*1 to the other bearing surface 114*b*2. Thereby the leakage of the waste toner stored in the waste toner storing portion 17 is prevented.

Since the second vibration absorbing member 102, which is a vibration absorbing member, also functions as a seal member (sealing member) which seals the toner inside the waste toner storing portion 17, it is unnecessary to add a separate seal member, whereby a process cartridge can be provided at low cost.

In this example, the second vibration absorbing member 102 also functions as a seal member, but the first vibration absorbing member 101 may be configured as a seal member, or both the first and second vibration absorbing members 101 and 102 may be configured as seal members.

As described above, according to this example, a cleaning apparatus or a process cartridge having a configuration to reduce noise can be provided at low cost by effectively attenuating the vibration of the cleaning blade.

Example 2

Now another example of this invention will be described. The basic configuration of the image forming apparatus and the process cartridge of this example is the same as Example 1. Therefore a composing element which is the same as or equivalent to Example 1 is denoted with the same reference sign, and detailed description thereof is omitted.

Figure 6:
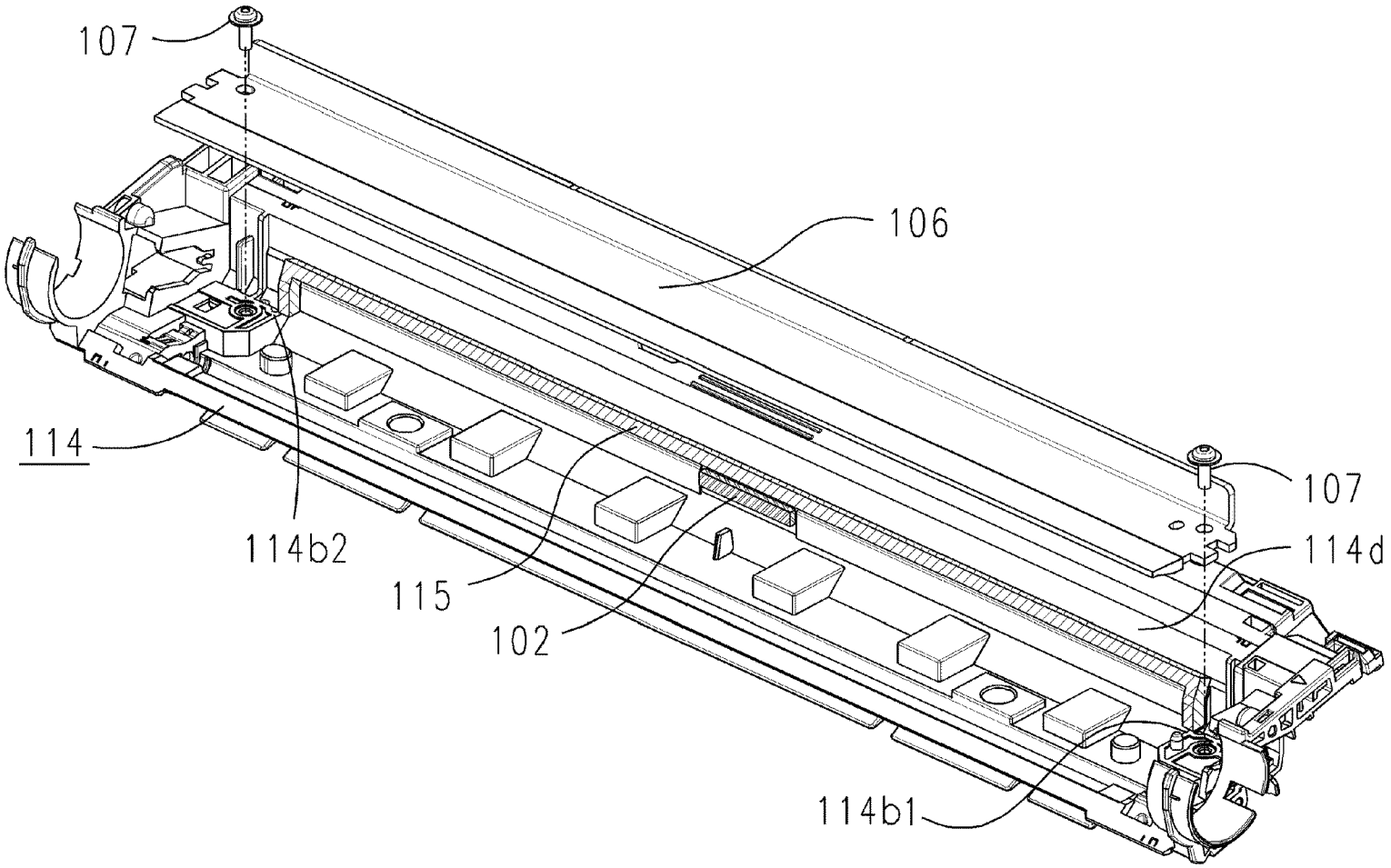
FIG. 6 is an exploded perspective view of a cleaning apparatus according to Example 2 of this invention.
Figure 7:
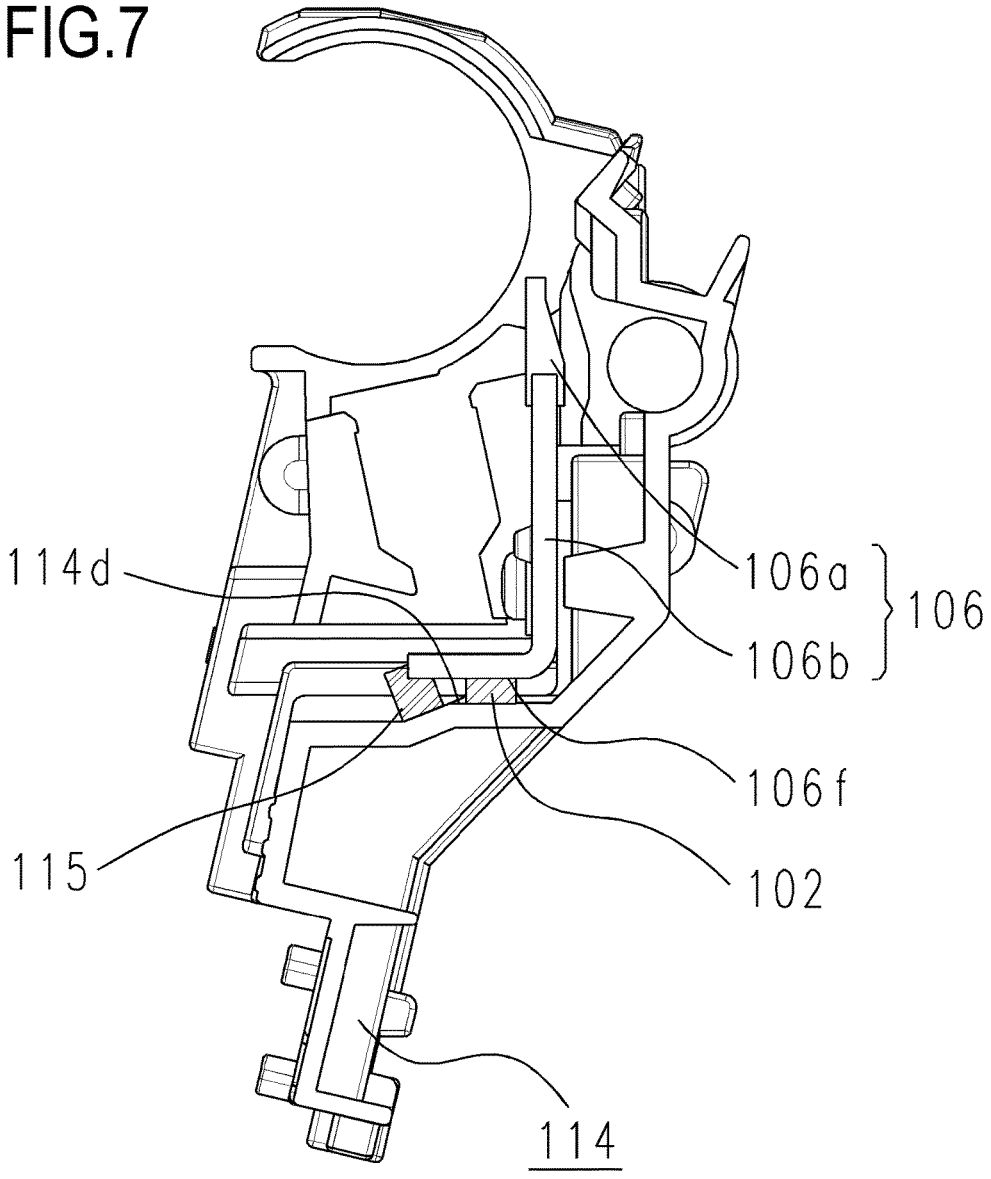
FIG. 7 is a schematic cross-sectional view of the cleaning apparatus according to Example 2 of this invention.

FIG. 6 is an exploded perspective view depicting the configuration of Example 2. FIG. 7 is a schematic cross-sectional view depicting the configuration of Example 2. The disposition of the second vibration absorbing member 102 and a seal member 115 will be described with reference to FIG. 6 and FIG. 7.

In Example 2, the second vibration absorbing member 102 is disposed between the second support portion 114*d* and the second plane 106*f*, not in the entire region along the photosensitive drum 1 in the axis line direction, but only in the region having the length less than ¼ of this region, including the center in the longitudinal direction along the axis line. In concrete terms, the cleaning blade 106 is fixed with the screws 107 and 107, so that the cleaning blade 106 is biased toward the cleaning frame 114, and is supported and secured by the bearing surfaces 114*b*1 and 114*b*2 disposed on both ends of the cleaning frame 114 in the axis line direction of the photosensitive drum 1. Therefore in the axis line direction, the vibration amplitude is highest at the middle point between the screws (fixed members) 107 and 107. Hence, if the second vibration absorbing member 102, of which length is ¼ of the length of the second support portion 114*d*, is disposed in the axis line direction (on a middle point) between the screws 107 and 107, such that the middle point, at which vibration is the greatest, is included in the axis line direction, then the vibration can be sufficiently suppressed. Here a material having high dynamic viscoelasticity is used for the second vibration absorbing member 102, and for example, a rubber having high vibration resistance, of which loss factor tan δ measured when a 100 Hz frequency of vibration is applied at the measurement temperature of 23° C.±2° C., is at least 0.6 and not more than 2.0, is used confirming to JIS K 6250.

For the sealing of the wasted toner storing portion, the seal member 115 is disposed in the entire region in the axis line direction. The seal member 115 prevents the leakage of the waste toner through the gap between the second support portion 114*d* of the cleaning frame 114 and the second plane 106*f* of the cleaning blade 106 in the entire region in the axis line direction. For the seal member 115, a material of which tan δ is small and repulsion is as low as possible, compared with the second vibration absorbing member 102, such as urethane foam, is used. In this configuration, the second vibration absorbing member 102 is disposed at the center portion in the longitudinal direction, where the vibration amplitude is highest, therefore vibration is sufficiently suppressed, and the seal member 115, of which tan δ is small, is disposed in the other region, thereby the coupling force between the cleaning blade 106 and the cleaning frame 114 is reduced, and the vibration transfer path can be minimized.

Figure 8:
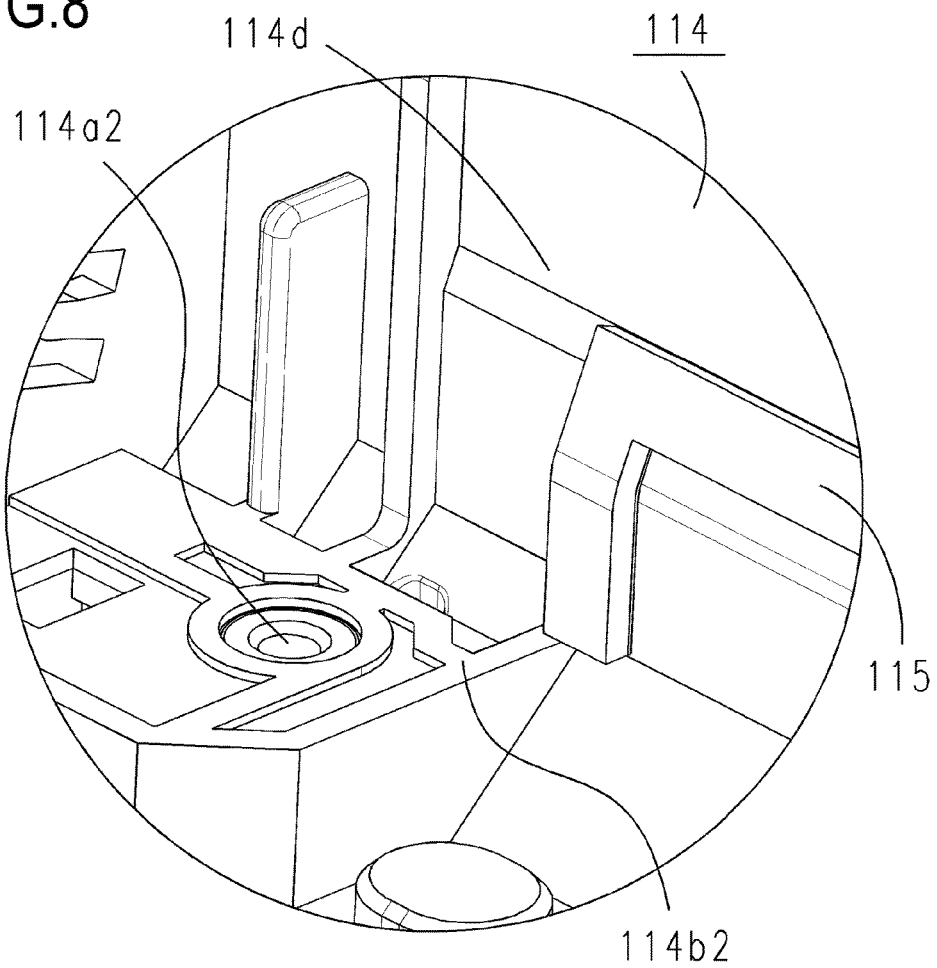
FIG. 8 is a diagram 1 depicting a toner sealing configuration of the cleaning apparatus according to Example 2 of this invention.
Figure 9:
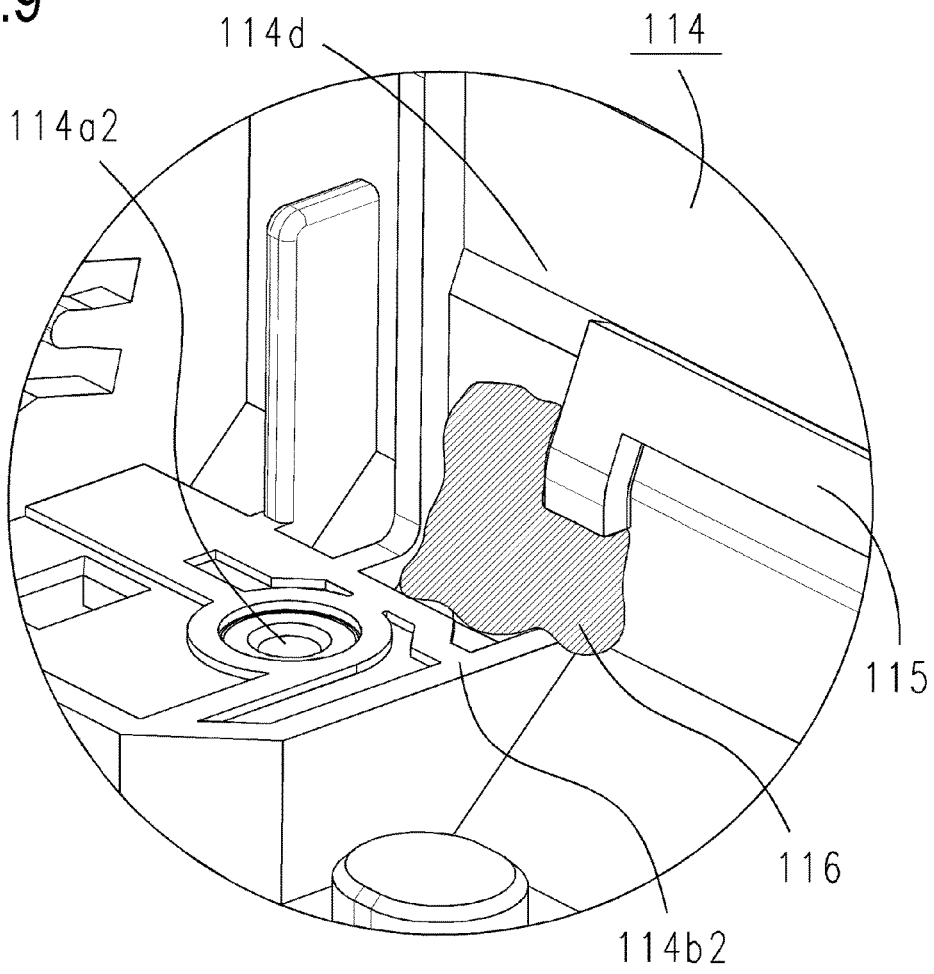
FIG. 9 is a diagram 2 depicting the toner sealing configuration of the cleaning apparatus according to Example 2 of this invention.

Further, in this example, as illustrated in FIG. 8, the seal member 115 is disposed so as to contact the bearing surface 114*b*2 (114*b*1) located at both ends of the cleaning frame 114 in the axis line direction of the photosensitive drum 1. Thereby the leakage of toner from the gap between the bearing surface 114*b*2 (114*b*1) and the seal member 115 can be prevented. Alternatively, a new edge seal member 116 may be disposed to seal the gap between the bearing surface 114*b*2 (114*b*1) and the seal member 115, as illustrated in FIG. 9.

By the above configuration, both suppressing vibration and reduction of the vibration transfer paths can be implemented, and a cleaning apparatus which can attenuate the vibration of the cleaning blade and reduce noise more effectively can be provided.

The configurations of the examples and modifications described above may be combined. For example, the first vibration absorbing member of Example 1 or each modification may be added to the configuration of Example 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-213548, filed on Oct. 31, 2016, and No. 2017-165699, filed on Aug. 30, 2017, which are hereby incorporated by reference herein in their entirety.

What is claimed is:

1. A cleaning apparatus that is attachable to and detachable from an image forming apparatus, comprising:

an image bearing member;

a blade member which includes an elastic member contacting the surface of the image bearing member, and a support member supporting the elastic member, the support member having a first surface that extends along a rotation axis direction of the image bearing member and a second surface that intersects with the first surface and that extends along the rotation axis direction;

a frame, to which the first surface of the support member is fixed at two fixed portions;

a vibration absorbing member, which is disposed between the frame and the second surface of the support member, and which is located between the two fixed portions when viewed along a direction perpendicular to the rotation axis direction; and a seal member, which is disposed between the frame and the second surface of the support member, and which seals a gap between the second surface of the support member and the frame, wherein the vibration absorbing member has a length that is not more than ¼ the length of the second surface in the rotation axis direction, and has a loss factor tan δ, measured when vibration at a 100 Hz frequency is applied at a measurement temperature 23° C.±2° C., of at least 0.6 and not more than 2.0, and wherein the seal member extends from a position overlapping with one of the two fixed portions to a position overlapping with the other fixed portion, in the rotation axis direction.

2. The cleaning apparatus according to claim 1, wherein the elastic member is disposed from one end to the other end of the support member in the rotation axis direction.

3. The cleaning apparatus according to claim 1, wherein the vibration absorbing member is disposed at a center between the two fixed portions in the rotation axis direction when viewed along the direction perpendicular to the rotation axis direction.

4. The cleaning apparatus according to claim 1, wherein the first surface and the second surface intersect orthogonal to each other.

5. The cleaning apparatus according to claim 1, wherein another seal member is disposed between the frame and the first surface of the support member, and seals a gap between the first surface of the support member and the frame.

6. The cleaning apparatus according to claim 1, wherein the support member is a metal plate which has a first plate portion having the first surface and a second plate portion having the second surface, and the elastic member is provided on the first plate portion.

7. The cleaning apparatus according to claim 6, wherein a bend line of the metal plate, at which the metal plate is bent to form the first plate portion and the second plate portion, is provided to be extending in a direction along the rotation axis direction.

8. The cleaning apparatus according to claim 1, wherein the first surface and the second surface are provided on one side of the support member, which is opposite to a side facing the image bearing member.

9. A process cartridge that is attachable to and detachable from an image forming apparatus, comprising a developing device and the cleaning apparatus according to claim 1.

* * * * *